US005964075A

United States Patent [19]

Daniele et al.

[11] Patent Number: 5,964,075

[45] Date of Patent: Oct. 12, 1999

[54] COVER OR LABEL-APPLYING ARRANGEMENT IN A MACHINE FOR THE AUTOMATED PACKAGING OF NEEDLES AND ATTACHED SUTURES

[75] Inventors: Robert A. Daniele, Flemington; Anthony Esteves, Somerville, both of N.J.

[73] Assignee: Ethicon, Inc., Somerville, N.J.

[21] Appl. No.: 09/019,673

[22] Filed: Feb. 6, 1998

[51] Int. Cl.[6] ..... B65B 63/04

[52] U.S. Cl. ..... 53/471; 53/118; 53/281; 53/430

[58] Field of Search ..... 53/116, 118, 281, 53/430, 471

[56] References Cited

U.S. PATENT DOCUMENTS

| | | |
|---|---|---|
| 2,620,028 | 12/1952 | Kohut . |
| 2,746,118 | 5/1956 | Drummond et al. . |
| 2,928,395 | 3/1960 | Forbes et al. . |
| 3,167,895 | 2/1965 | Egler et al. . |
| 3,611,551 | 10/1971 | Shave et al. . |
| 3,618,282 | 11/1971 | Hagel et al. . |
| 3,811,244 | 5/1974 | Killen et al. . |
| 3,816,889 | 6/1974 | Crotti . |
| 3,875,946 | 4/1975 | Duncan . |
| 3,980,177 | 9/1976 | McGregor . |
| 4,011,155 | 3/1977 | Fenerstein et al. . |
| 4,072,041 | 2/1978 | Hoffman et al. . |
| 4,255,917 | 3/1981 | Stone . |
| 4,424,898 | 1/1984 | Thyen et al. . |
| 4,651,879 | 3/1987 | Harris et al. . |
| 4,672,871 | 6/1987 | Gudinestad . |
| 4,722,384 | 2/1988 | Matsutani . |
| 4,744,035 | 5/1988 | Hashim . |
| 4,806,737 | 2/1989 | Coates . |
| 4,832,025 | 5/1989 | Coates . |
| 4,922,904 | 5/1990 | Uetake et al. . |
| 5,056,658 | 10/1991 | Sobel et al. . |
| 5,065,237 | 11/1991 | Tsikos et al. . |
| 5,150,307 | 9/1992 | McCourt et al. . |
| 5,226,336 | 7/1993 | Coates . |
| 5,230,424 | 7/1993 | Alpern et al. . |
| 5,253,765 | 10/1993 | Moorehead et al. . |
| 5,438,746 | 8/1995 | Demarest et al. . |
| 5,452,636 | 9/1995 | Rarton . |
| 5,469,689 | 11/1995 | Demarest et al. . |
| 5,473,810 | 12/1995 | Demares t et al. . |
| 5,473,854 | 12/1995 | Demarest et al. . |
| 5,477,609 | 12/1995 | Demarest et al. . |
| 5,485,668 | 1/1996 | Demarest et al. . |
| 5,487,212 | 1/1996 | Demarest et al. . |
| 5,487,216 | 1/1996 | Demarest et al. . |
| 5,491,954 | 2/1996 | Sobel ..... 53/281 X |
| 5,491,955 | 2/1996 | Sobel ..... 53/281 X |
| 5,500,991 | 3/1996 | Demarest et al. . |
| 5,511,670 | 4/1996 | Demarest et al. . |
| 5,660,024 | 8/1997 | Ivanov et al. ..... 53/430 |
| 5,661,954 | 9/1997 | Ivanov et al. ..... 53/430 |
| 5,664,404 | 9/1997 | Ivanov et al. ..... 53/430 |
| 5,873,212 | 2/1999 | Esteves et al. ..... 53/118 |

FOREIGN PATENT DOCUMENTS

| | | |
|---|---|---|
| 428253 | 5/1991 | European Pat. Off. . |
| 581699 | 2/1994 | European Pat. Off. . |
| 2632850 | 12/1989 | France . |
| 89 04 145 | 7/1989 | Germany . |
| 63-212027 | 9/1988 | Japan . |
| 63-299834 | 12/1988 | Japan . |
| 3-82458 | 4/1991 | Japan . |
| 3-106530 | 5/1991 | Japan . |

*Primary Examiner*—Daniel B. Moon

[57] ABSTRACT

A machine for the automated packaging of armed sutures or; in effect, surgical needles having sutures attached thereto and, more particularly, an arrangement and a method for applying covers to package trays in an automated machine for the highspeed individualized packaging of single or individual surgical needles each having an attached suture into a tray and detachable cover providing a suture package utilized for the packaging of the individual or single needles and attached sutures.

16 Claims, 10 Drawing Sheets

COVER OR LABEL-APPLYING ARRANGEMENT IN A MACHINE FOR THE AUTOMATED PACKAGING OF NEEDLES AND ATTACHED SUTURES

BACKGROUND OF THE INVENTION

1. Field of the Invention

The present invention relates to a machine for the automated packaging of armed sutures or; in effect, surgical needles having sutures attached thereto and, more particularly, pertains to an arrangement and a method for applying covers or labels to package trays in an automated machine for the high-speed individualized packaging of single or individual surgical needles each having an attached suture into a tray and detachable cover providing a suture package utilized for the packaging of the individual or single needles and attached sutures. Additionally, the automated packaging machine incorporates operative mechanism adapted to wind the sutures into a peripheral channel of the tray and facilitating the attachment of the cover to the tray which contains the single needle and attached wound suture, and which cover concurrently constitutes a product-identifying label as a component of the tray. The cover being shaped such that removal of the cover is not necessary to enable a user to gain access to the contents of the tray; in essence, the armed suture.

The automated packaging machine also provides for a rotary turret or dial-like turntable for the high-speed loading thereof with empty trays; the sequential loading of successive forwardly indexed trays each with a needle and attached suture; the indexed advance of the needle and suture-filled tray to suture-winding stations of the machine; the conveyance of the trays each containing the needle and attached wound suture to a cover-applying station of the machine to provide the completed suture packages, and the further advance of the suture packages for subsequent automated removal of the completed suture packages from the machine. The automated packaging machine is resultingly adapted to provide for the continuous and repetitive production of suture packages in a single high-speed production cycle without necessitating any manual manipulation thereof.

In order to facilitate the production of the suture packages as described herein, the present invention provides for a plurality of sequential operating stations, in which a first station includes carousel structure having stacked package trays sequentially conveyed to a rotary plate element which slices off and separates the bottommost package tray from a stack of trays, and includes operative structure for transferring the separated package tray to a tool nest mounted on a rotary dial for transfer to subsequent processing stations, where the package tray is provided with an armed suture, the suture wound into the package tray, a cover applied thereto to produce the finished package and which is then removed from the packaging machine and further transported for additional processing and/or storage.

The invention as described herein is particularly concerned with the features of the automated packaging machine which is directed to the application of covers, which may be label-forming components, to packaging trays each containing a single surgical needle and attached suture to resultingly produce complete suture packages. This cover application is accomplished through the supplying of individual covers from a stack of such covers to a rotary plate, removing the covers in succession from the rotary plate through the intermediary of a robotic pivot arm arrangement which, in turn, transfers the covers onto successive suture trays which are supported on tool nests mounted on a turntable of the packaging machine.

The present invention as set forth herein is also specifically directed to the provision of a novel method for the automated feed or supplying of label-forming covers for packaging trays each containing a single surgical needle and attached suture from a stack of such covers, and thereafter effectuating the sequential application of the covers to successive packaging trays through the intermediary of automated robotic pivot arm structure so as to thereby produce completed suture packages.

Currently, in the medical, surgical and health-related technology, the high-speed and efficient packaging of either single or multiple sutures which are each suitably attached to surgical needles, such as by being swaged or similarly fastened thereto, and in which such combined sets of needles and sutures are generally referred to as armed sutures, is imparted an increasing degree of importance in view of the rising demand of users for such combined surgical needles and attached sutures, and various diverse types of inexpensively manufactured suture packages for the containment of needles and attached sutures have been developed and are presently widely employed.

In specific instances, suture packages may be covered tray-shaped containers designed to receive and fixedly retain therein one or more needles and therewith attached sutures, in which the suture packages, upon opening of the covers, must enable the uncomplicated and simple withdrawal of a respective individual needle and its attached suture in a smooth unobstructed manner. In essence, when the needle which is to be removed from the suture package is engaged by a surgeon or health professional, for example, by being gripped through the intermediary of a forceps and then pulled out of the suture tray, it is essential that the needle easily disengage from its restraint in the package while the suture which is attached to the needle should also be readily able to slip out of the tray in the absence of any binding or snagging, and in the instance of the tray housing a plurality of armed sutures also without becoming entangled with other sutures still remaining in the suture tray or package. Thus, pursuant to a specific needle and suture package construction which, for example, may comprise an injection-molded plastic tray, the needles are generally engaged by clamping structure located in the tray so as to be "parked" or retained in predetermined position or array in a central region of the tray. The sutures extending from the needles to which they are attached are then conducted under tension and wound into a peripheral channel formed within the suture tray responsive to rotation of the latter so as to extend along the peripheral interior length of the channel. This positioning of the needles, and particularly that of the sutures within the peripheral channel of the tray is intended to eliminate tight bends or curves normally imposed on the sutures so as to facilitate their easy withdrawal from the suture package.

2. Discussion of the Prior Art

Until relatively recently, the introduction of needles with attached sutures into suture packages or molded plastic trays was being implemented in a substantially manual manner. In that instance, the needles were manually placed into the tray so as to be clampingly engaged by means of suitable needle-gripping structure, and thereafter the attached sutures wound or positioned within the confines of the tray. Subsequently, a suitable cover was superimposed upon and fastened to the filled tray, and the resultant armed suture package conveyed to a suitable arrangement for possible sterilizing or further over wrapping.

The foregoing essentially manual and relatively basic process for winding the sutures into the tray, and especially the locating thereof into the peripheral channel of the tray during manipulation of the tray, was quite time-consuming, and in conjunction with the manual application of the cover into the tray in a basically individual or piece-by-piece mode, represented a serious hindrance to a large volume or mass produced manufacturing output, and adversely affected the economics in attempting to provide such large quantities of suture packages containing either single or multiple surgical needles and attached sutures.

As an improvement over the foregoing, there was then developed a generally semi-automated winder machine for packaging surgical needles and attached sutures in a tray-like suture package, and wherein at least some of the previously manually implemented packaging steps were to some extent automated in order to be able to increase the output of needle and suture-containing packages while simultaneously reducing the number of manual procedures in effectuating the packaging of those particular items.

To that effect, the semi-automated winder machine, although necessitating the manual orientation of the trays for implementing the filling thereof with needles and attached sutures, included a winding station which to a considerable degree automated the winding process for the sutures so as to place the latter into a peripheral channel extending about the circumference of the tray. Also provided was a further therewith operatively associated device which enabled covers to be manually placed on the needle and suture-filled trays to be fastened thereto by means of a pressing die forming latchingly engaging interconnections between each of the covers and the trays, while concurrently producing from a portion of the cover a product-identifying label which remains permanently attached to the tray upon subsequent detachment of the cover. Although providing a considerable advance over the state-of-the-art in the packaging of needles and sutures, the semi-automated winder machine nevertheless necessitated the implementation of a considerable number of manual and labor-intensive handling steps in effectuating the filling of the trays with surgical needles and attached sutures, attaching the cover and, generally, producing complete suture packages.

As a further technological advance over the foregoing semi-automated needle and suture package-forming concept, there was then developed a substantially fully automated packaging machine which is adapted, in a highly efficient and extremely rapid mode, to continually fill successive trays of the type described hereinabove with pluralities of surgical needles and attached sutures, and subsequently causing the sutures to be wound into the confines of the tray, such as into a peripheral channel extending about the tray. Thereafter, the packaging machine was designed to implement the automated positioning and fastening of covers to the needle and suture-filled trays to produce completed suture packages of the type described hereinabove, which were then adapted to be transported to a suitable locale for selective further processing, such as sterilizing, and/or over wrapping, as is required by this technology.

In particular, the automated packaging machine was designed to provide the packages with each housing a plurality of needles and attached sutures. For example, the packaging machine for accomplishing the foregoing, which is commonly assigned to the assignee of the present application, is described in U.S. Pat. Nos. 5,487,212; 5,473,854; 5,469,689; 5,473,810; 5,511,670; 5,452,636; 5,438,746; 5,500,991; 5,477,609; 5,485,668; and 5,487,216.

The flat, tray-shaped suture package produced by the packaging machine set forth in the above-mentioned patents provides for the storage therein of multiple surgical needles and attached sutures, while concurrently recognizing the need to facilitate the smooth and unobstructed withdrawal of individual needles and attached sutures from the suture package. For instance, such a suture package is disclosed in applicants' U.S. Pat. No. 5,230,424, which is commonly assigned to the assignee of the present application; and wherein the suture package is referred to as an RSO package (Reduced Size Organizer).

In the specific design of the flat tray-shaped plastic container having a peripheral channel as disclosed in the above-mentioned patent, the suture package is basically constituted of a rectangular round-cornered and flat-bottomed injection-molded plastic tray having a flat central surface area including a raised needle clamping structure formed thereon for engaging and "parking" a plurality of needles in a predetermined spaced array. Sutures each have one end thereof attached to each of the respective needles so as to form so-called "armed sutures". The sutures extend from each of the needles into a channel extending about the perimeter or periphery of the suture tray and are conducted into the channel so as to be essentially wound within the circumferential confines of the suture tray. The plurality of sutures which are positioned within the suture tray channel are protected against inadvertent outward displacement therefrom through the presence of a multiplicity of contiguously positioned resilient fingers which are integrally molded with the suture tray, and which project outwardly above the confines of the channel along a major portion of the length of the channel and, collectively, form a so-called "zipper structure" in which the inherently resilient nature of the fingers facilitates their temporary raising up to enable the introduction of the sutures into the suture tray channel by means of a suitable suture winding apparatus.

Although the rotary dial or turntable apparatus of the packaging machine pursuant to the foregoing U.S. patents provides for the packaging of armed sutures; in effect, needles with attached sutures, in a rapid and fully automated manner, such as by supplying the tray-shaped packages; thereafter parking the plurality of armed sutures in the packages, applying covers and removing the completed suture packages from the machine in a sequential station-to-station procedure, the machine was designed to primarily produce suture packages each containing a plurality of armed sutures.

SUMMARY OF THE INVENTION

Pursuant to the present inventive concept, the above-mentioned automated packaging machine is further improved upon in a novel and unique manner in that the machine is adapted to produce suture packages each containing a single armed suture, such packages being frequently in demand rather than packages containing a plurality of needles and sutures. Thus, in order to provide for high production rates which are essentially compatible with those employed in the manufacture of suture packages each containing a plurality of armed sutures, the present invention contemplates the provision of a fully automated packaging machine with a considerably increased rate of operating speed and production capability so as to render the packaging machines economically viable in comparison with the previously described automated packaging machine, while maintaining structural and functional reliability and ease of construction and maintenance.

In order to attain the essentially automated packaging of singly-packaged or individual surgical needles with attached sutures, the automated packaging machine pursuant to the invention sets forth the provision of a rotary turret or dial-like turntable having a plurality of tool nests each possessing a suture tray supporting surface, with each tool next being circumferentially spaced about the turntable so as to be uniformly distributed about the periphery thereof. The rotary turret is rotated to cause the tool nests supporting packaging trays to be indexed forwardly so as to advance through a plurality of successive workstations which are adapted to, respectively, effectuate the supplying of each of the trays located on the tool nests or support surfaces with a single or individual surgical needle and attached suture, winding the suture into the confines of each needle and suture-containing tray, forming a latching engagement between a tray cover and the tray; and thereafter conveying each completed suture package to a station for removal from the machine and transfer to stacking bins or the like.

Operatively communicating in synchronism with the indexing rotation of the rotary turret is a carousel device housing stacks of trays, which is adapted to supply empty trays sliced or separated from the bottom of a respective stack of the trays to a rotatable platform, and includes operative robotic pivot arm structure to successively remove the trays from the rotatable platform and mount the empty trays on successive tool nests so as to be oriented in a vertical plane facing radially outwardly of the rotary turret. Thereafter, each tray is indexed sequentially forwardly by the rotary turret to a workstation which will impart movement to a portion of the tool nest having the tray supported thereon, whereby the tray remains oriented essentially vertically it is rotated angularly relative to the horizontal plane of rotation of the rotary turret. This movement enables a transfer device with a needle and suture swaging mechanism processing needle grippers at a further workstation to insert and position a surgical needle with its attached suture into a therewith aligned tray for retentive engagement with needle-engaging structure formed in the tray so as to grip and park the needle therein, with the suture extending from the needle and depending downwardly therefrom outwardly of the tray. The needle and suture-containing tray is then advanced forwardly on its respective tool nest to successive workstations responsive to indexed of the rotary turret wherein, at a first suture winding station, structure operatively cooperating with the tray and the tool nest supporting the tray imparts an initial rotational movement to the tray about an axis perpendicular to the plane of the while maintaining tray the depending suture under tension, and at a second subsequent winding station imparts a rapid winding motion to the tray over multiple predetermined rotations so as to fully wind the downwardly depending suture into a peripheral tray channel extending within the perimeter of the tray.

Thereafter, the tool nest mounting the tray with the needle parked therein and the attached suture which has been wound into the peripheral channel of the tray is advanced to a further workstation responsive to indexed rotation of the rotary turret; at which workstation an operating mechanism causes a bottom-most cover to be sliced or separated from a stack of covers and transferred to a rotatable platform. The cover is then engaged by a robotically-controlled pivot arm which, pivots the cover into a vertical orientation and applies the cover onto the tray while concurrently imparting pressure to the cover to cause cooperating latching structure to clampingly fasten the cover to the needle and suture-containing tray. Upon completion of the cover-attaching sequence, the resultingly completed suture package is indexed to a further workstation at which suitable grippers on arm mechanism engages the suture package, and the suture package is disengaged from the tool nest on which it is supported and conveyed, transferred to and stacked in repository or receiving units to be readied for further processing, such as sterilizing, overwrapping or the like, as may be required.

The foregoing sequence of operative steps is continually repeated for each successive tool nest on the rotary turret or turntable sequentially receiving empty trays from the carousel, while preceding tool nests each mounting a tray are conveyed through the above-mentioned packaging cycle. Thus, a successive tray is always placed into a position of readiness at a following or subsequent workstation and processed in a similar manner as before described during the forward indexing motion of the rotary turret or turntable. This ensures a continuously repetitive packaging cycle for successive suture packages in a highly efficient and high-speed operation without the need for any manual intervention in the operation of the packaging machine.

Intermediate various of the workstations as set forth hereinbefore; there may be arranged other workstations incorporating sensors adapted to enable ascertaining the presence of empty trays at the initial workstation, for a verification of a needle having been inserted into the trays and for inspection of the trays subsequent to the winding of the sutures into the tray channels; checking for the application of the covers to the trays, and facilitating the possible ejection of incomplete trays or the removal from the machine of defective packages.

Pursuant to the present invention, there is provided at a workstation for applying a covers or labels to the needle and suture-containing package tray, suitable apparatus which will in a rapid sequence receive the needle-containing package tray from suture winding workstations, and position the tray in readiness for the application of a package cover so as to form a completed suture package.

In connection with the foregoing, the arrangement for applying the covers includes an upright structure including an open-bottomed chute having a stack of a covers superimposed therein, and wherein the open bottom of the chute is arranged above a rotatable plate member. The plate member includes recesses spaced about the annular extent thereof which are adapted to pass beneath the chute bottom, and through the intermediary of a suitable vacuum separate a bottommost of the covers from the stack of covers, and rotate these on the plate member through a predetermined angle so that these are advanced in sequence opposite a respective tool nest supporting the needle and suture-containing package tray. A robotic pivot arm which is operatively connected to a suitable source of vacuum moves downwardly so as to lift a respective one of the covers upwardly from its position on the rotatable plate member opposite the tool nest, pivots the cover upwardly into alignment with the tray which is mounted on the tool nest, and then advances towards the tool nest while releasing the vacuum and enabling the cover to be engagingly applied to the package tray under pressure exerted by the pivot arm.

Thereafter, the pivot arm is retracted and swung downwardly to pick up a subsequent cover on the rotatable plate while the tool nest carrying the completed package is advanced towards a subsequent station for removal of the completed suture package, and a subsequent tool nest mounting a package tray with needle and suture contained therein is advanced into alignment with the robotic arm arrangement for effectuating the pick-up and positioning of a subsequent cover onto the tray.

Accordingly, it is an object of the present invention to provide a novel arrangement for the application of covers onto package trays having surgical needles and attached suture arranged therein so as to form a complete suture package.

Another object of the present invention resides in the provision of an arrangement for applying covers or labels to package trays containing armed sutures, through the intermediary of suitable program-controlled robotic pivot arm structure.

A more specific object of the present invention resides in the provision of an arrangement for applying label-forming covers onto package trays containing single surgical needles and attached sutures wherein individual covers are separated from the bottom of a stack of covers and deposited onto a rotatable plate, robotic pivot arm structure picks up covers in succession from the rotatable plate and applies the covers to package trays in latching engagement therewith while the trays are supported on tool nests mounted on a turntable of the packaging machine.

Still another object of the present invention resides in the provision of a method for applying covers or labels to package trays containing armed sutures by utilizing the robotic pivot arm arrangement pursuant to the automated packaging machine of the present invention.

BRIEF DESCRIPTION OF THE DRAWINGS

Reference may now be had to the following detailed description of a preferred embodiment of the invention, taken in conjunction with the accompanying drawings; in which.

DETAILED DESCRIPTION OF THE PREFERRED EMBODIMENT

Figure 1:
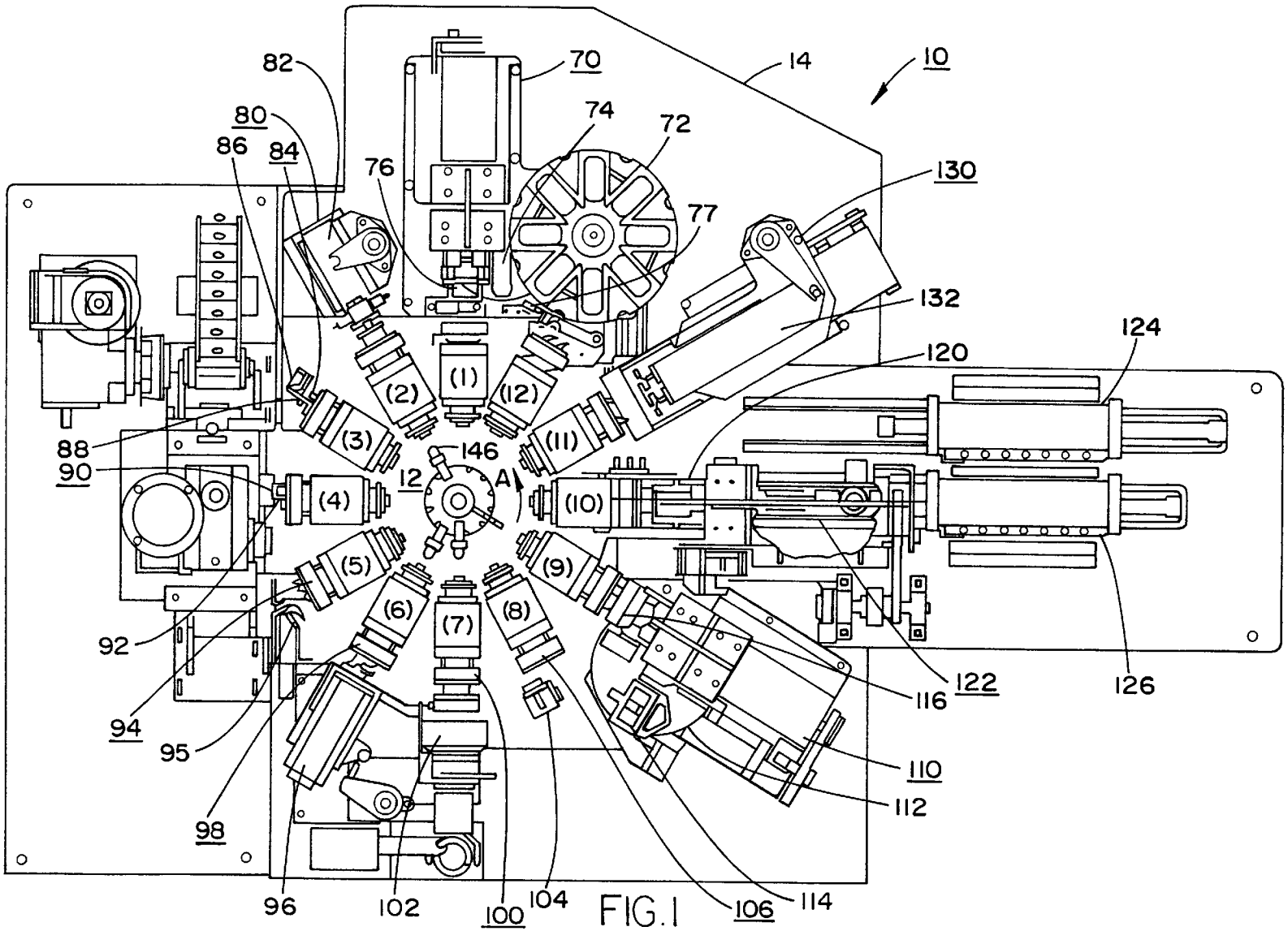
FIG. 1 illustrates generally diagrammatically, a plan view of the machine for the automated packaging of individual surgical needles and attached sutures, pursuant to the present invention.
Figure 2:
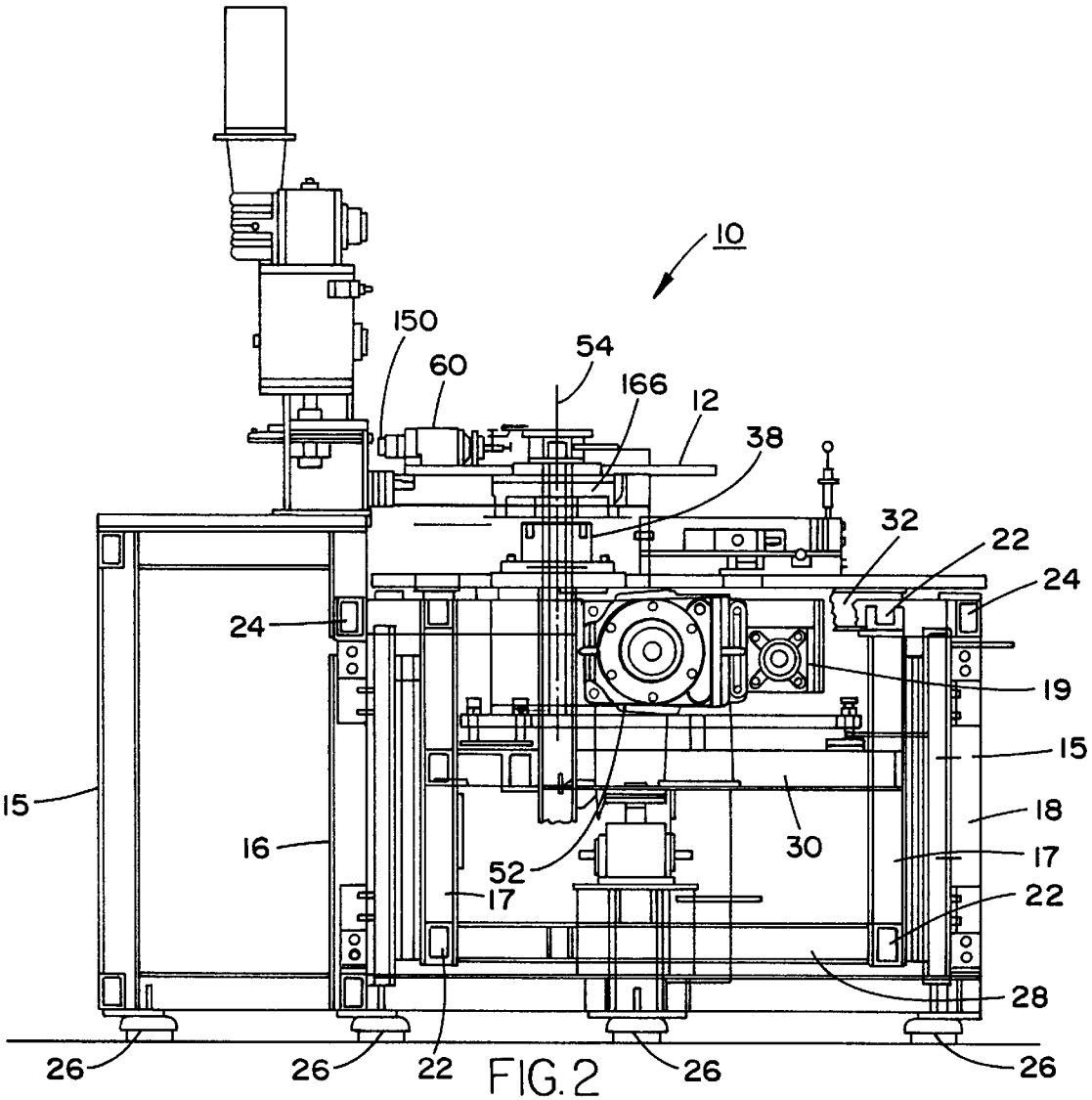
FIG. 2 illustrates a side elevational view of the machine frame of FIG. 1.
Figure 3:
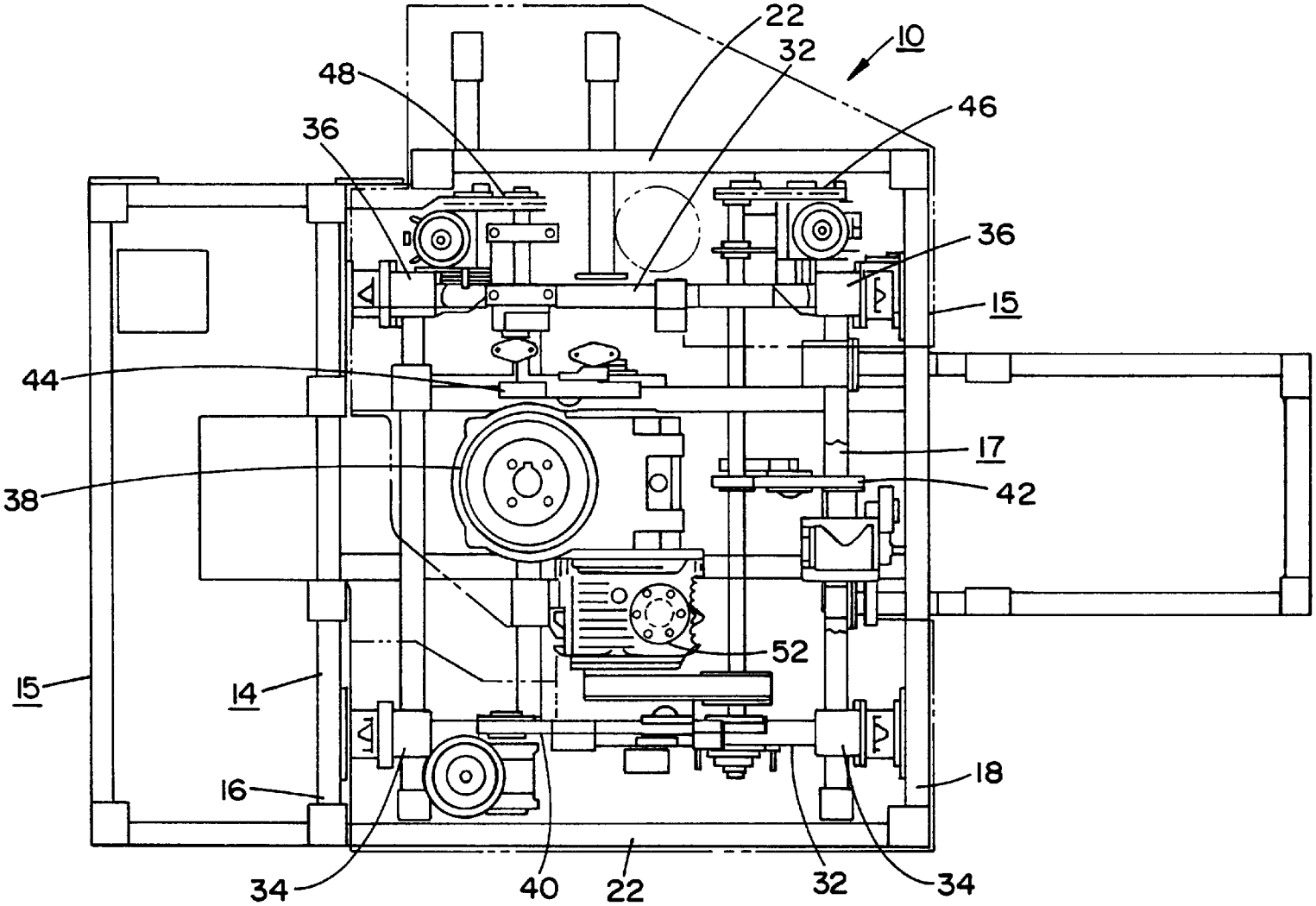
FIG. 3 illustrates a top plan view of the machine frame of FIG. 2.

Referring now in more specific detail to the drawings, FIGS. 1 to 3 illustrate, in a generally diagrammatic plan view, the automated needle and suture packaging machine 10 pursuant to the invention. The machine 10 comprises a rotary turret or turntable 12 which is essentially a packaging dial supported on an essentially stationary machine frame structure 14.

Figure 4:
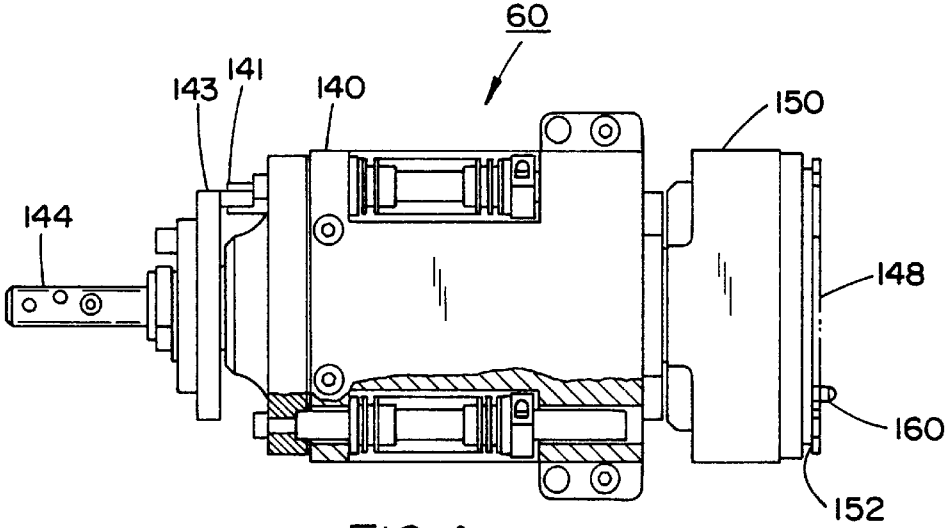

The rigid frame structure 14, as illustrated in FIGS. 2 through 4, basically includes structural uprights 16 and 18, which are interconnected by horizontal beams 20, 22, 24, with the entire frame structure 14 adapted to be supported on a floor through the intermediary of adjustable leveling footings 26. The frame structure 14 comprises an outer stationary frame arrangement 15, and an inner vertically adjustable frame arrangement 17 comprising horizontal beams 28, 30 and 32, and vertical beams 34, 36 interconnected therewith supporting the turntable 12 for vertical adjustment relative to the stationary machine frame components. The vertical adjustment of the frame arrangement 17 is provided for by a central servo moror actuated jack screw 38, which also concurrently effectuates the vertical adjustment of all of the operative packaging devices at the various workstations of the machine so as to accommodate the packaging of a wide range of differently sized surgical needles without the necessity for modifying any machine components. Arranged within the frame structure are the various belt drives 40, 42, 44, 46 and 48 and operating drive components 50 for the machine, and the vacuum-generating systems 52 employed in the packaging cycles for the suture packages, as described hereinbelow. The turntable 12 is oriented in a horizontal plane, and through the intermediary of a program-controlled drive installation, is rotatable in an indexing or incrementally angular advance about a central vertical axis 54. In this instance, during operation of the machine, the turntable 12 is rotated in a counter-clockwise direction when viewed from above, as represented by arrow A, so as to be advanced in 30° increments.

The rotary turret or turntable 12 is essentially constituted of a circular disk-shaped member or packaging dial which has a plurality of tool nests 60 mounted thereon. The tool nests 60 are mounted in a circumferentially uniformly spaced array on the upper surface of the package dial or rotary turret 12, and with each tool nest 60 having an outer end projecting radially outwardly of the peripheral edge of the turret or dial 12, as described hereinbelow.

In this particular construction of the packaging machine 10, by way of example, twelve (12) tool nests 60 are arranged at uniformly distributed annular spacings of 30° from each other about the circumference of the dial or rotary turret 12.

In essence, as mentioned hereinbelow, the rotary turret or turntable 12 of the packaging machine 10 is adapted to be indexed forwardly in an angularly incremental or indexed rotational advance, each such incremental advance comprising one-twelfth of the 360° circumferential rotation of the turntable, or basically 30°, along the direction of rotation identified by arrow A in FIG. 1, such that the tool nests 60 which are each adapted to mount a suture tray or package are designed to be advanced in sequence to a number of successive workstations; designated herein as workstations (1) through (12), which are stationarily evenly spaced about the periphery of the rotary turret 12, as illustrated in FIG. 1 of the drawings.

The successive workstations which collectively constitute the automated machine 10 for the packaging of surgical needles and attached sutures are essentially briefly described as follows; viewed in the direction of rotation of arrow A:

(1) A first workstation 70 relates to the operative aspect of empty suture package trays being successively separated from the bottom of stacks of trays contained in a rotary carousel 72 to be transferred onto a rotationally indexed plate 74 under the action of a vacuum, and thereafter picked up and transferred by a cam-controlled robotic pivot arm structure 76 to successive tool nests 60 so as to be retained thereon while being conveyed by the rotary turret or dial 12 to subsequent workstations, as set forth hereinbelow.

(2) At this workstation 80, to which the respective tool nest 60 supporting the empty tray thereon has been advanced by the rotational advance of the turntable 12 mounting the tool nest; in effect, indexed 30° forwardly; operative slide-controlled pivot structure 82 engages a plate element on the outer end of the tool nest 60 which supports the empty tray under a vacuum, and rotates the plate element and tray counterclockwise within the vertical plane thereof about a horizontal radial axis of the tool nest 60 through an angle of approximately sixteen and one-half (16.5°) degrees so as to be in appropriate angular orientation relative to a horizontal axis for facilitating the subsequent insertion and retention of a surgical needle and attached suture into the tray.

(3) This workstation 84 provides for a sensor 86 which is mounted stationarily on a bracket arrangement 88 and faces the tool nest 60 so as to be able to check for the presence of an empty tray on the tool nest. The sensor 86 is suitably aimed at a black spot present on the packaging tooling nest, and in the absence of a tray being positioned thereon, enables deactivating the forward advance of the turntable 12 and concurrently may emit a signal to alert personnel regarding the missing tray.

(4) The next workstation 90 along the rotational path of motion of the turntable in the direction of arrow A, provides gripper mechanism 92 for inserting a single surgical needle and a therewith attached suture into the suture tray which has been indexed forwardly by the rotary turret 12 so as to be located in operative alignment with the needle-feed mechanism. The needles are conveyed by a mechanism so as to be mounted on suitable clamping or needle "park" structure constituting an integral portion of the tray. Vacuum-controlled suture capture and tensioning devices which are located below each tool nest 60, become operative at this workstation to capture and tension the suture portions depending outwardly and downwardly of the tray mounting the surgical needle.

(5) At this workstation 94, a stationary sensor 95 located radially outwardly of the turntable 12 may be utilized to ascertain the presence of a surgical needle and attached suture having been properly introduced into the tray at the previous workstation 90.

(6) A first tray winding mechanism 96 at this workstation 98 engages the plate element on the tool nest supporting the tray, while the suture capture and tensioning device ensures that the suture portion depending outwardly and downwardly from the tray is maintained under tension by a vacuum-operated tensioning device associated therewith, with the tray being rotated counterclockwise within its vertical plane through approximately 163.5°, to assume a horizontal orientation which is 180° inverse to its original orientation on the tool nest 60 at workstation (1), and with the remaining length of the suture being tensioned by the vacuum device externally of the tray.

(7) At a subsequent workstation 100, a further winding mechanism 102 engages the tool nest 60 and the tray mounted thereon, and imparts rapid rotation to the tray so as to enable tray structure engaging portions of the mechanism to introduce and completely wind the entire remaining length of the suture into a peripheral groove extending about the confines of the tray.

(8) A stationary sensor 104 at this workstation 106 is located radially outwardly of the turntable 12, and is adapted to ascertain the positioning of the surgical needle in the tray.

(9) This workstation 110 provides apparatus for the application and attachment of a cover or label to the tray containing the surgical needle and attached suture to produce or complete suture to produce a complete suture package. A rotatably indexed disc-like plate 112 includes a plurality of equidistantly circumferentially spaced cover-receiving areas, these being rotated below a vertical stack 114 of covers or labels such that, under the action of a vacuum, the bottommost covers of the stack are sequentially sliced off or separated and deposited into a respective area of the plate under the influence of the vacuum present therebeneath, and thereafter rotated into radial alignment with a tool nest 60 mounting the tray containing the surgical needle and attached wound suture. A cam-controlled robotic pivot arm structure 116 lifts the cover from the plate, while a subsequent area receives a further cover from the stack for transfer onto a following tray, and pivots upwardly and extends horizontally forwardly so as to position the cover into latching engagement with the tray, thereby forming the completed suture package.

(10) A robotic pivotable gripper arm 120 removes the completed package from the tool nest 60 at this subsequent workstation 122, and swings downwardly so as to deposit the completed suture package into receiving bins or compartments within elongated tray members 124 whereby upon a certain amount of trays being deposited to fill the tray member the latter is indexed to align a further empty compartment of a tray member with the tool nests. The tray member having the various filled compartments is then conveyed to a storage unit 126 and replaced automatically by another empty tray member.

(11) In the event of a suture package being defective, such as having a cover lacking or misplaced, and the resultant package has accordingly not been removed at the preceding package unloading workstation 122; at this workstation 130 a reciprocating arm structure 132 has a gripper head which engages and removes the rejected packages from the tool nests, and deposits them onto a conveyor belt 134 for conveyance to a suitable waste disposal site.

(12) A sensor 77 at the final workstation on the packaging machine 10 checks for the presence of a package that may not have been removed at stations (10) and (11). This is a further safegard built into the packaging machine to ensure that the tool nest at station (1) is empty and ready to accept an empty package tray.

Figure 6:
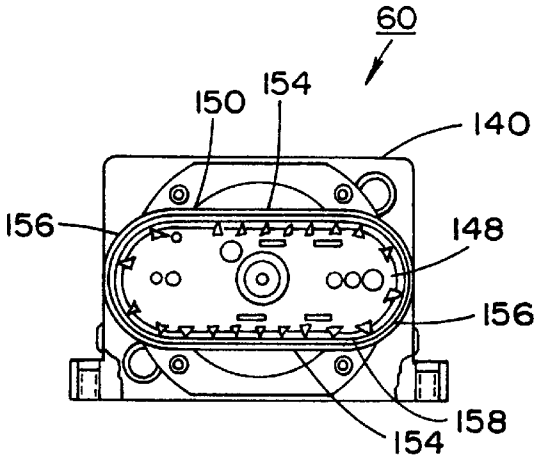
FIGS. 4, 5, and 6 illustrate, respectively, side, top plan and front end views of a tool nest utilized in the machine of FIG. 1.
Figure 5:
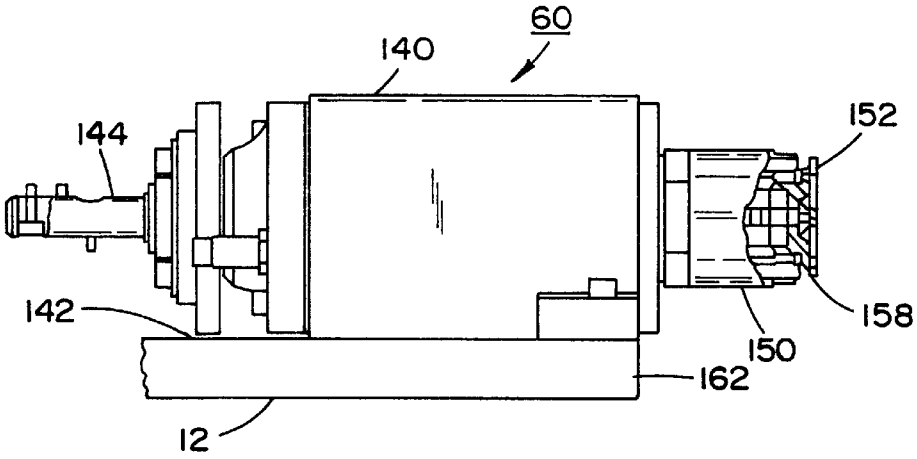

As shown in FIGS. 4 through 6, each tool nest 60 includes a housing 140 which is fixedly mounted on the upper surface 142 of the rotary turret 12. Each housing 142 includes a horizontal radially extending central through bore having a shaft 144 rotatably journaled therein. The shaft 144 is normally secured against rotation within housing 140; however, at predetermined workstations of the machine, the shaft 144 may be released by means of a locating pin 141 so as to be axially radially inwardly movable within housing 140 against stationary cam structure 143 mounted centrally on the rotary turret or dial 12 for regulating the rotational displacement which may be imparted to the shaft 144, as discussed hereinbelow in more specific detail.

The radially outwardly facing structure 148 of a plate element 150, which is fixedly secured to the radially outer end of shaft 144, is adapted for supporting suture package components, and particularly the package trays which are utilized in the production of surgical needle and attached suture-containing packages.

In essence, the radially outer structure of the tool nest housing 140 for mounting suture trays includes the plate element 150 which comprises an elongate vertically oriented plate member 152 having generally parallel opposite sides 154 and convexly rounded opposite ends 156 so as to be generally in conformance with the peripheral shape of a package tray. An external planar surface on the plate member 152 includes protruding perimeter or rim structure 158 for seating engagement therein of a suture tray, with the plate member 152 being fixedly secured to the radially outer end of the shaft 144 so as to be adapted for rotation therewith. Extending forwardly from the external planar surface of the rotatable plate member 152 of the tool nest 60 are protuberances or guide pins 160 which are intended to align the package tray thereon for appropriate positioning on the plate member 152, with the tray adapted to be retained thereon through the application of a vacuum to the exterior plate member surface through passageways communicating with a vacuum source connected thereto through the tool nest housing 140.

Figure 7:
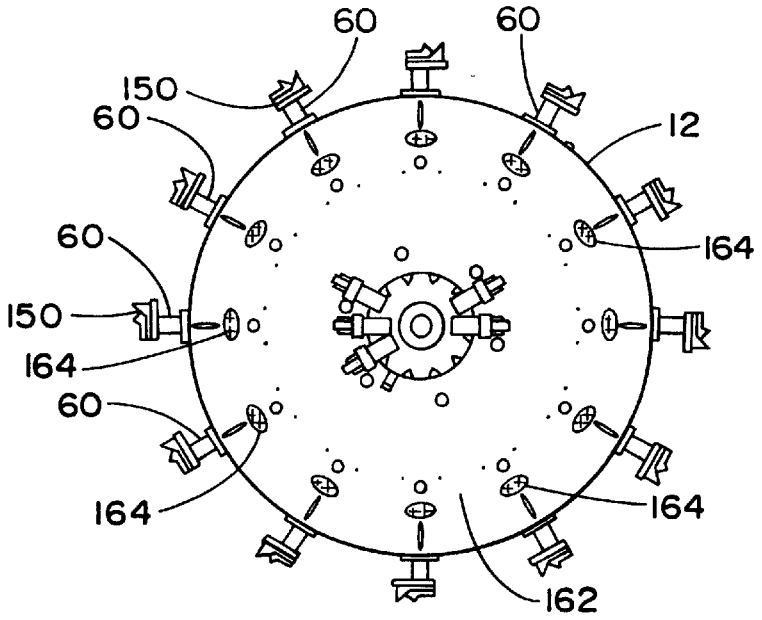
FIG. 7 illustrates a bottom view of the turntable, showing the vacuum ports for communicating the tool nests with a source of vacuum.
Figure 8:
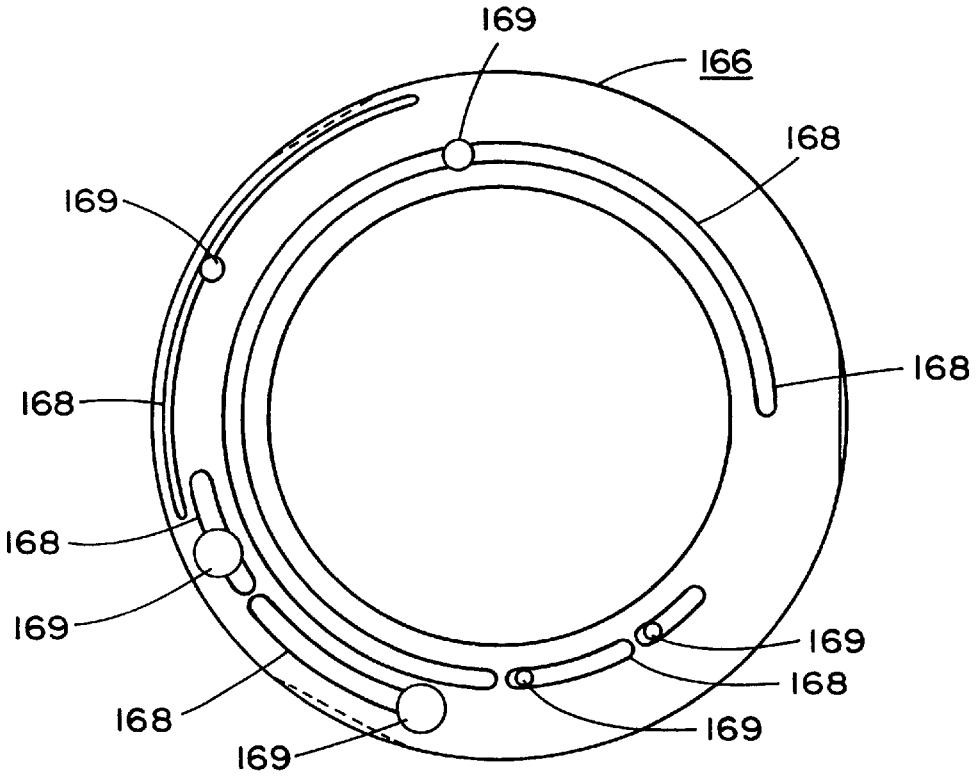
FIG. 8 illustrates a vacuum plenum for supplying the vacuum ports of FIG. 7 with controlled vacuum conditions.

The vacuum passageways extend through the lower surface 162 of the dial or turntable 12, as shown in FIG. 7, which includes a plurality of apertures 164 each communicating with, respectively, passageways leading to an associated tool nest 60. The vacuum is supplied to the apertures 164 in a selective controlled mode through the intermediary of a stationary vacuum plenum 166 arranged below the dial 12, as shown in FIG. 2 of the drawings. The plenum 166, as shown in FIG. 8, includes outlet slots 168 and ports 169 for applying or closing a vacuum to respective tool nests 60 in accordance with the rotational positions of the dial 12 with the aperture or ports 164 in the lower surface 162 being in communication with the vacuum plenum outlet slots or ports.

Figure 9:
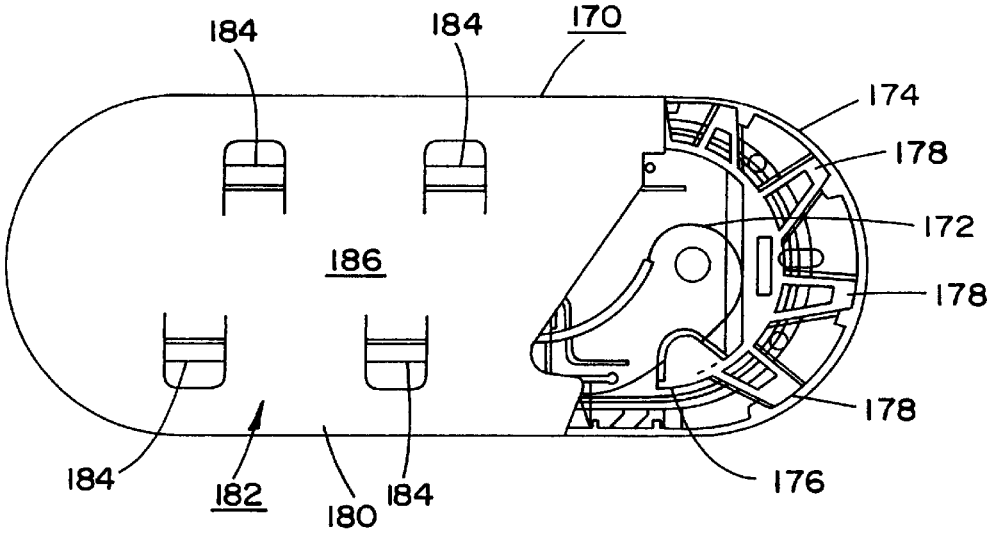
FIG. 9 illustrates a front view of a completed suture package with the cover having been applied thereto by the inventive cover-applying arrangement.
Figure 10:
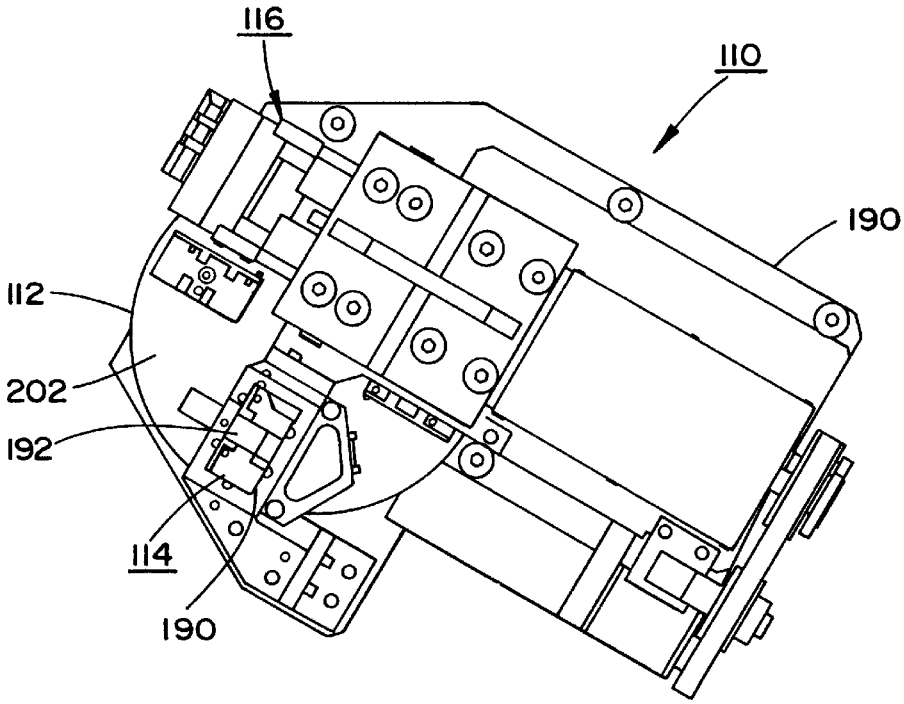
FIG. 10 illustrates a plan view of the cover-applying arrangement for the suture packaging machine.

The suture package tray 170, as shown in FIG. 9 of the drawings, is essentially constituted of molded plastic material, and includes a planar base 172 with parallel sides and semi-circular rounded ends. A vertical wall 174 extends about the perimeter of the tray, while inwardly spaced thereof is a second vertical wall 176 having radially outwardly extending fingers 178 which are flexible at the upper edge reaching close to the outer wall 174 so as to define a hollow channel structure. Apertures and surgical needle engaging structure is molded into the tray, as more specifically disclosed in copending U.S. patent application Ser. No. 08/521,978; filed Aug. 31, 1995 now U.S. Pat. No. 5,660, 024, the disclosure of which is incorporated herein by reference, and which is commonly assigned to the assignee of this application.

The packaging tray 170 is shown with the cover 180 having been applied thereto so as to produce a complete suture package 182 having a single needle and attached suture arranged therein. The cover 180 extends over only a portion of the packaging tray area so as to afford visual inspection of the contents of the suture package. Interengageable latching structure 184, such as cut-outs and flaps, formed on the cover and package tray ensure their latched engagement upon application of the cover 180 to the packaging tray 170. The cover surface 186 may be provided with suitable printing whereby the cover, in essence, also constitutes a label for the suture package.

Figure 13:
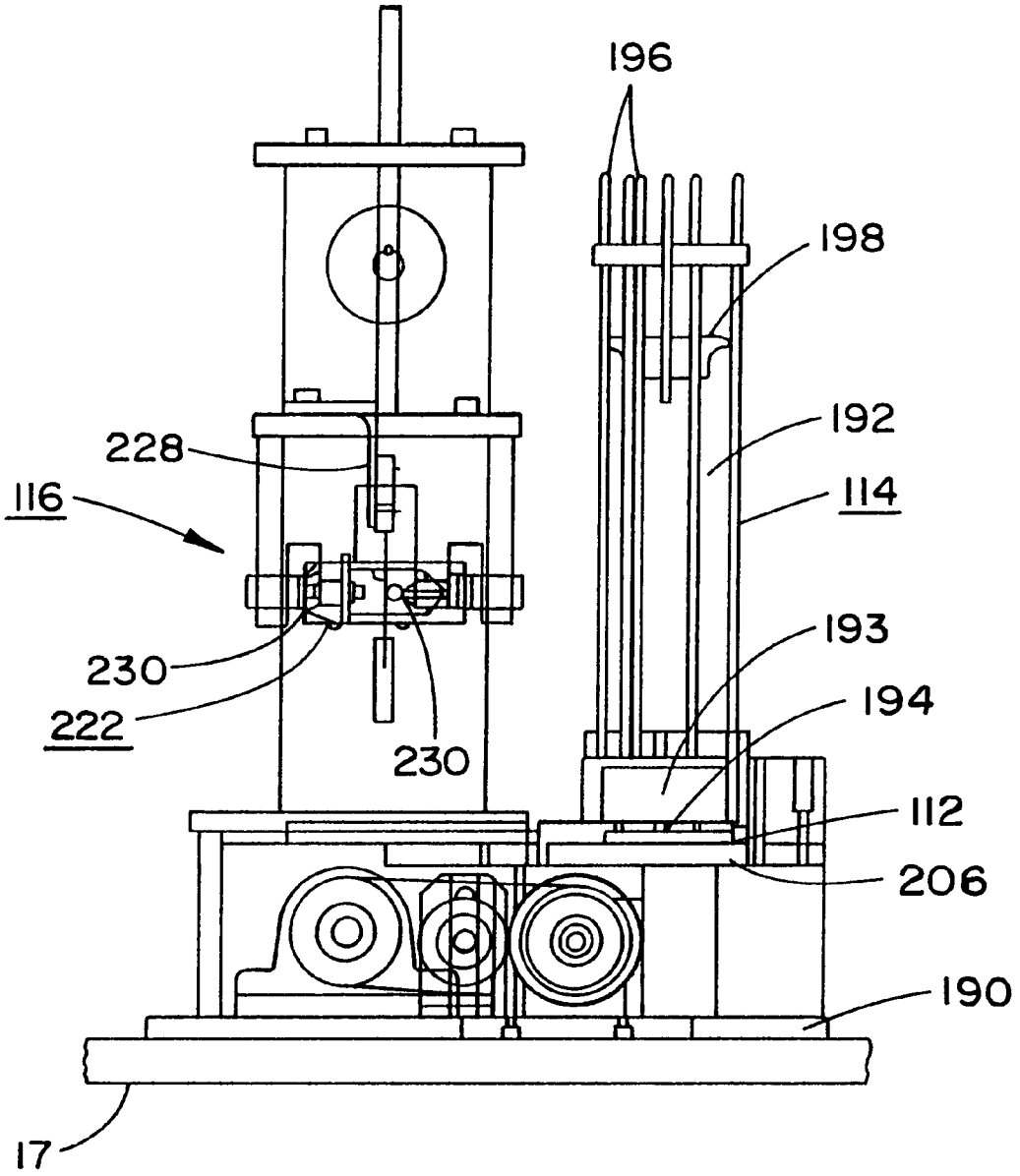
FIG. 13 illustrates, diagrammatically, an elevational view of the cover-applying arrangement of FIG. 10.

Referring to the features of the invention which are more specifically directed to the workstation 110 (9) wherein covers 180 are applied onto respective package trays 170 each containing a single surgical needle and attached suture to form a suture package 182 as shown in FIG. 9, there is disclosed a platform arrangement 190 on which there is mounted a stationary vertical structure 114, as shown in FIG. 13, comprising an open-bottomed chute 192 for the positioning therein of a stack of superimposed lay flat covers 180, such as are shown in FIG. 9, mounted on trays 170.

Figure 17:
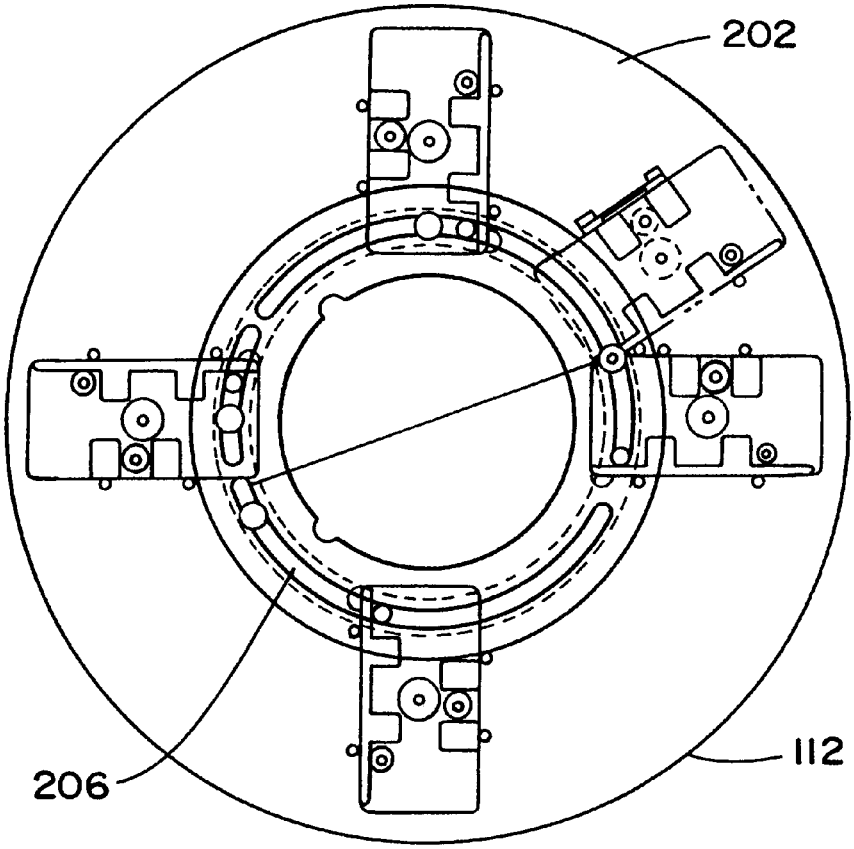
FIGS. 17 and 18 illustrate, respectively, bottom plan and sectional views of a rotary slice plate employed in the mechanism of FIGS. 10 and 11.
Figure 18:
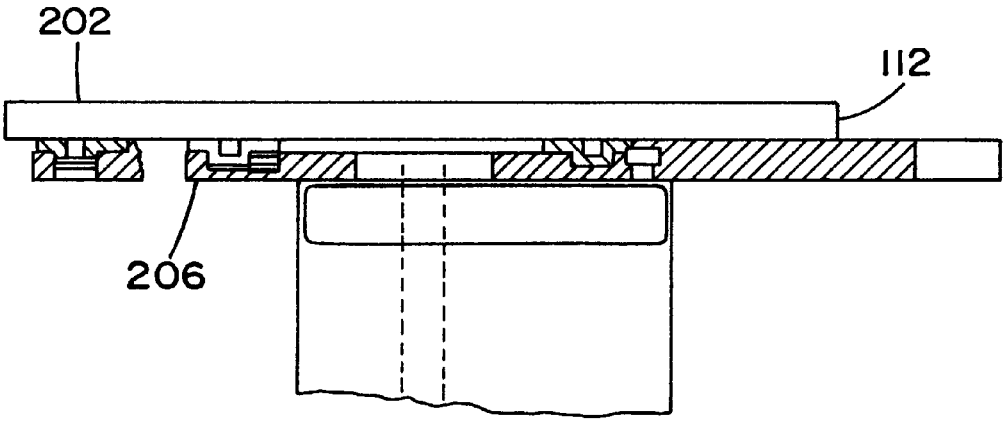

The lower end 194 of the chute 192 containing the stack of covers 180, and which consists of a spaced rod arrangement 196, with a weight 198 on the covers 180 to press them downwardly, is located in close proximity above a rotatable disc-like plate element 112. As shown in FIGS. 17 and 18, the rotatable plate element 112, which is adapted to be driven by a drive arrangement 200, includes plurality of defined surface areas 202; for example, four areas located at 90° annular spacings from each other, which each conform to respectively the shape of a cover 180.

Between the chute 192 and the rotatable plate element 112 is a single multi-cover buffer area 193 for storage of a buffer stack of covers 180. The buffer area 193 allows the chute 192 to be removed and reloaded with covers 180 without stopping the machine. Therefore, covers 180 can be continuously loaded into the rotatable plate element 112 from the buffer stack of covers 180 without interrputing the packaging process.

Thus, during the indexed rotational movement of the plate element 112, a bottommost cover 180 of the buffer stack is sliced off or separated and deposited onto respectively a surface area 202 located therebelow on the upper surface 204 of the plate element 112 which is in alignment therewith. This transfer of successive covers 180 from the chute 192 is implemented through the intermediary of applying a vacuum by means of a vacuum plenum 206 to the applicable surface area 202 through a suitable channel 204 which is in communication with a source of vacuum. Accordingly, each time a surface area 202 on plate element 112 passes beneath the bottom of the buffer area containing the buffer stack of covers 180, one cover 180 is sliced off or separated from the bottom of the buffer stack and deposited under a vacuum on the rotatable plate element 112.

At a point in time when a cover 180 on the surface area 202 is located opposite a program-controlled robotic pivot arm structure 116 which is located 180° rotationally displaced from the chute 192 containing the stack of covers 180, as shown in FIGS. 10 through 13, one of the covers 180 is picked up from plate element 112 for transfer and placement on a packaging tray 170 located on a tool nest 60.

Figure 11:
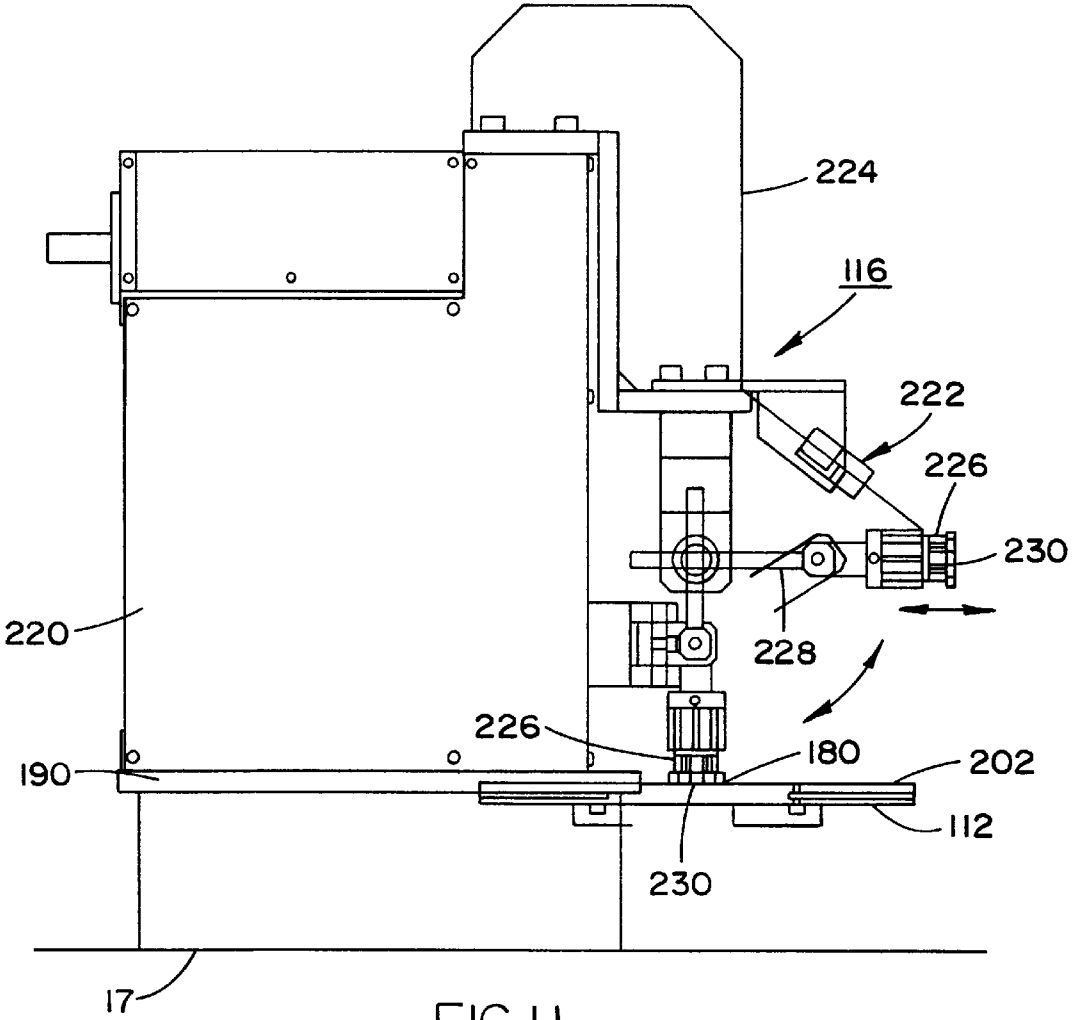

As shown in drawing FIGS. 11 through 16, the pivot arm structure 116 includes a housing 220 which is mounted on the platform arrangement 190, and with a portion of plate element 112 rotating below the housing 220, as shown in FIG. 11. The housing 220 contains actuating and robotically-controlled driving devices (not shown) for operating a pivot arm mechanism 222 which is movably attached to housing portion 224.

Figure 12:
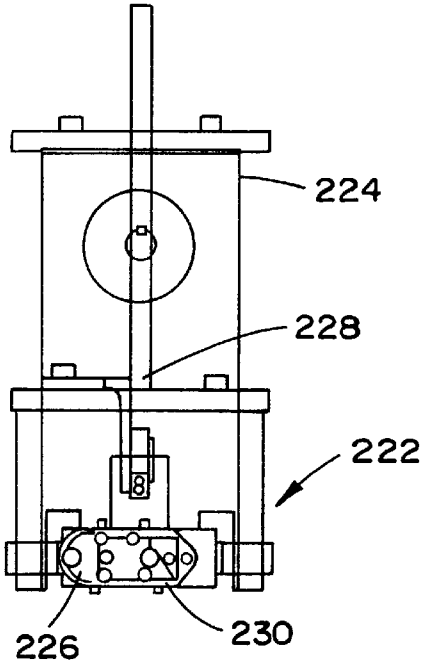
FIGS. 11 and 12 illustrate, respectively, side elevational and partial front views of the cover-applying pivot arm mechanism for producing the suture package of FIG. 9.
Figure 14:
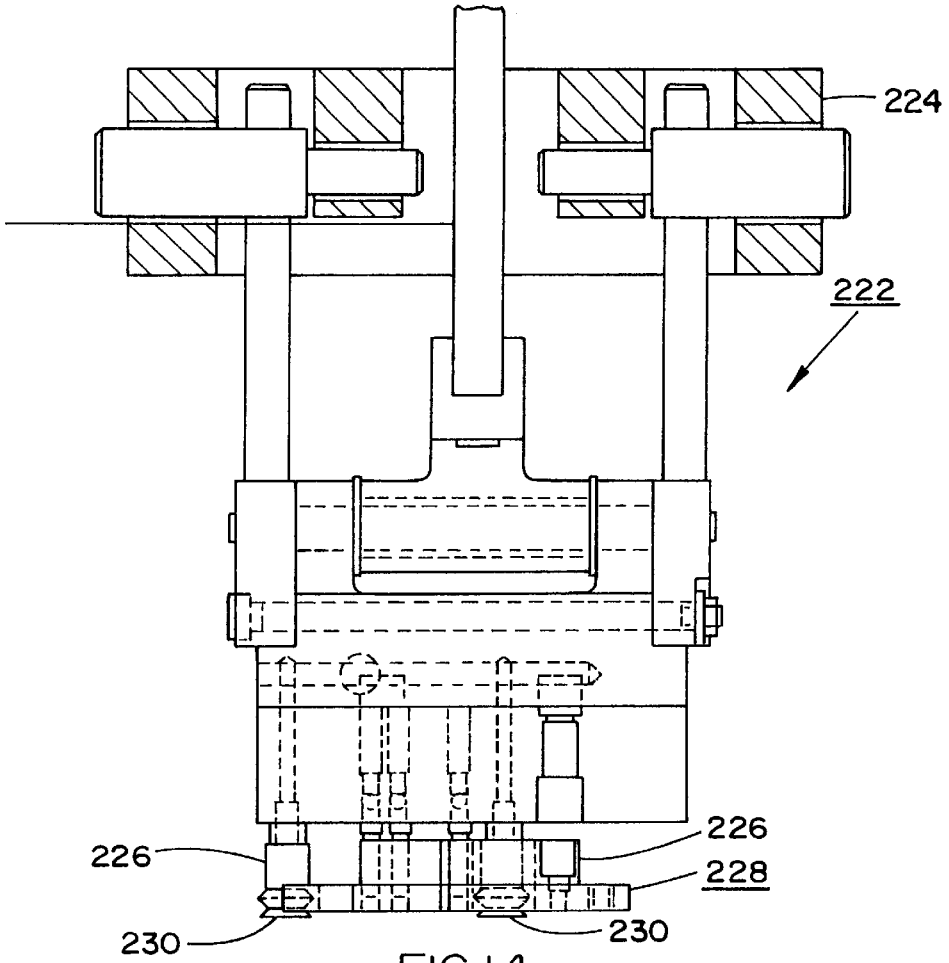
FIG. 14 illustrates, partly in section, a plan view of the pivot arm structure of the mechanism of FIG. 12.
Figure 15:
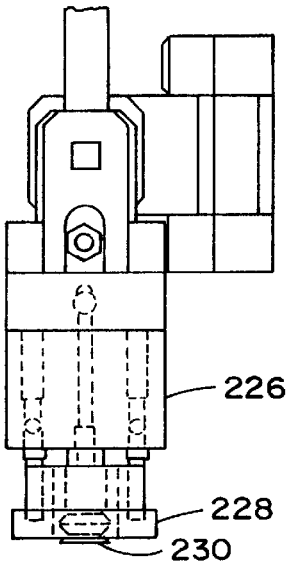
FIG. 15 illustrates a partial side view of the pivot arm structure of FIG. 14.
Figure 16:
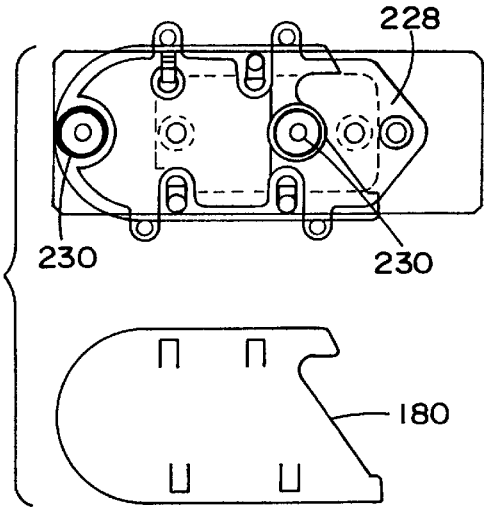
FIG. 16 illustrates a front view of the pivot arm structure of FIG. 14, and a cover which is to be applied thereby on a package tray containing a surgical needle and attached suture.

Referring to FIGS. 11 and 12, wherein the former shows the pivot arm in two operative positions, the free end 226 of the pivot arm 228 includes a surface 230 forming a suction device which is adapted to pick up a cover 180 through the intermediary of suction passages 232 communicating with a vacuum-generating source. As illustrated in FIGS. 14 to 16, linkage elements 234 which are pivotably hinged to housing portion 224 facilitate the pivoting and also axially displaceable movement of pivot arm 228.

Referring to FIG. 11, in the downward position of pivot arm 228, while connected to a vacuum source, the arm 228 is pivoted downwardly to enable the pick-up of the cover 180 by the suction device 230 under the aspirating action of the vacuum, while a vacuum acting on the plate surface area 202 of plate element 112 at that location is released. This causes the cover 180 to adhere to the pivot arm suction device 230. Thereafter the pivot arm 238 is swung upwardly into the horizontal orientation shown in FIGS. 11 and 12 so as to align the cover 180 with a needle and suture-containing package tray 170 located on the plate element 150 of a tool nest 60 which is in operative alignment therewith. The pivot arm 228 with the cover 180 thereon at and 230 is then advanced forwardly so as to cause the cover 180, to be pressed into latching engagement with the package tray 170, as shown in FIG. 9, thereby forming a complete suture package. At this time, the vacuum in the suction device 230 is released, and this completes the application of the cover 180 to the tray 170. This will then enable the robotic pivot arm 228 to be retracted and pivoted downwardly so as to be able to repeat the operative sequence described above with regard to a successive cover which has been rotated into position therebeneath on the plate element 112, while the tool nest 60 with the completed suture package is advanced forwardly to a package unloading workstation. A successive tool nest 60 having a package tray 170 with a surgical needle and wound suture arranged therein is concurrently indexed into position opposite the robotic pivot arm 228 by the indexed advance of turntable 12 so as to enable the foregoing cycle of applying a cover 180 onto a tray 170 to be repeated.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A cover-applying arrangement in a machine for the automated packaging of a single needle having an attached suture to produce a suture package, wherein said machine automatically winds said suture within confines of a tray and attaches a cover to said tray so as to constitute said suture package, said machine having at least one tool nest for supporting said tray, and means for imparting a forwarding motion to said tool nest and said tray supported thereon for indexed advance to a plurality of workstations stationarily arranged proximate a path of advancing movement of said at least one tool nest; said cover-applying arrangement comprising:

(a) means for applying a cover to a tray containing a surgical needle and attached suture, said tray being positioned on a support surface located on said at least one tool nest, said cover-applying means comprising means for stacking a supply of said covers; a rotary plate arranged beneath said cover stacking means, said rotary plate being adapted to receive an individual one of said covers from a bottom of said cover stacking means; means for indexing said rotary plate forwardly at predetermined angular increments; and motive means for engaging said cover on said rotary plate and transferring said cover for application to the tray which is mounted on the support surface of said at least one tool nest.

2. An arrangement as claimed in claim 1, wherein said cover stacking means comprises an open-bottomed chute having a vertical stack of said covers arranged therein, said rotary plate being horizontally oriented and extending closely below the bottom of said chute so as to receive the bottommost cover therefrom on an upper surface of said rotary plate.

3. An arrangement as claimed in claim 2, wherein said rotary plate is in communication with a vacuum-generating source for imparting a vacuum to the upper surface of said rotary plate so as to retain said cover thereon during at least the indexing advance of said rotary plate.

4. An arrangement as claimed in claim 1, wherein said motive means comprises pivotable arm structure having cover-engaging means for lifting said cover from said rotary plate and transferring said cover for application onto the tray on the support surface of said at least one tool nest.

5. An arrangement as claimed in claim 4, wherein said rotary plate communicates with a vacuum-generating source for imparting a vacuum thereto for retaining said cover on said plate, said vacuum being released upon said cover-engaging means contacting said cover, and a vacuum in said cover-engaging means retaining said cover thereon to facilitate transporting said cover for application to the tray on the support surface of said at least one tool nest.

6. An arrangement as claimed in claim 5, wherein upon said cover-engaging means applying said cover to said tray on the support surface of said at least one tool nest, said vacuum in said cover-engaging means is released and a vacuum concurrently applied to the support surface of said at least one tool nest so as to retain said formed suture package thereon.

7. An arrangement as claimed in claim 1, wherein said motive means comprises a cam-controlled robotic pivot arm adapted to swing between a vertical orientation to a horizontal and forward motion for transporting said cover from said rotary plate to said tray on the support surface of said at least one tool nest.

8. An arrangement as claimed in claim 1, wherein a plurality of said tool nests are mounted on a turntable, said workstations being spaced about said turntable.

9. A cover-applying method in a machine for the automated packaging of a single needle having an attached suture to produce a suture package, wherein said machine automatically winds said suture within confines of a tray and attaches a cover to said tray so as to constitute said suture package, said machine having at least one tool nest for supporting said tray, and means for imparting a forwarding motion to said tool nest and said tray supported thereon for indexed advance to a plurality of workstations stationarily arranged proximate a path of advancing movement of said at least one tool nest; said cover-applying method comprising:

(a) applying a cover to a tray containing a surgical needle and attached suture, said tray being positioned on a support surface located on said at least one tool nest, said covers being in a stack; a rotary plate arranged beneath said cover stack, said rotary plate being adapted to receive an individual one of said covers from a bottom of said cover stack; indexing said rotary plate forwardly at predetermined angular increments; and engaging said cover on said rotary plate and transferring said cover with motive means for application to the tray which is mounted on the support surface of said at least one tool nest.

10. A method as claimed in claim 9, wherein an open-bottomed chute has a vertical stack of said covers arranged therein, said rotary plate being horizontally oriented and extending closely below the bottom of said chute so as to receive the bottommost cover therefrom on an upper surface of said rotary plate.

11. A method as claimed in claim 10, wherein said rotary plate is in communication with a vacuum-generating source for imparting a vacuum to the upper surface of said rotary plate so as to retain said cover thereon during at least the indexing advance of said rotary plate.

12. A method as claimed in claim 9, wherein said motive means comprises pivotable arm structure having cover-engaging means for lifting said cover from said rotary plate and transferring said cover for application onto the tray on the support surface of said at least one tool nest.

13. A method as claimed in claim 12, wherein said rotary plate communicates with a vacuum-generating source for imparting a vacuum thereto for retaining said cover on said plate, said vacuum being released upon said cover-engaging means contacting said cover, and a vacuum in said cover-engaging means retaining said cover thereon to facilitate transporting said cover for application to the tray on the support surface of said at least one tool nest.

14. A method as claimed in claim 13, wherein upon said cover-engaging means applying said cover to said tray on the support surface of said at least one tool nest, said vacuum in said cover-engaging means is released and a vacuum concurrently applied to the support surface of said at least one tool nest so as to retain said formed suture package thereon.

15. A method as claimed in claim 9, wherein said motive means comprises a cam-controlled robotic pivot arm adapted to swing between a vertical orientation to a horizontal and forward motion for transporting said cover from said rotary plate to said tray on the support surface of said at least one tool nest.

16. A method as claimed in claim 9, wherein a plurality of said tool nests are mounted on a turntable, said workstations being spaced about said turntable.

* * * * *